US011228849B2

(12) United States Patent
Piechowiak et al.

(10) Patent No.: US 11,228,849 B2
(45) Date of Patent: Jan. 18, 2022

(54) HEARING AIDS WITH SELF-ADJUSTMENT CAPABILITY BASED ON ELECTRO-ENCEPHALOGRAM (EEG) SIGNALS

(71) Applicants: GN Hearing A/S, Ballerup (DK); City University of New York

(72) Inventors: Tobias Piechowiak, Ballerup (DK); Andrew Dittberner, Antioch, IL (US); Lucas Cristobal Parra, Brooklyn, NY (US); Ivan Vladimirov Iotzov, New York, NY (US)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 16/236,373

(22) Filed: Dec. 29, 2018

(65) Prior Publication Data

US 2020/0213779 A1 Jul. 2, 2020

(51) Int. Cl.
*H04R 25/00* (2006.01)

(52) U.S. Cl.
CPC ..... *H04R 25/505* (2013.01); *H04R 25/604* (2013.01); *H04R 2225/41* (2013.01); *H04R 2225/43* (2013.01)

(58) Field of Classification Search
CPC ..... H04R 25/30; H04R 25/50; H04R 25/505; H04R 25/55; H04R 2225/41;
(Continued)

(56) References Cited

U.S. PATENT DOCUMENTS 8,559,645 B2 10/2013 Corona-strauss et al.
9,025,800 B2 5/2015 Kidmose et al.
(Continued)

FOREIGN PATENT DOCUMENTS

EP 2997893 A1 3/2016
EP 3163911 5/2017
(Continued)

OTHER PUBLICATIONS

Vanthornhout, Jonas, et al. "Speech Intelligibility Predicted from Neural Entrainment of the Speech Envelope", Feb. 20, 2018, Journal of the Association for Research in Otolaryngology, JARO 19: 181-191. (Year: 2018).*
Vanthomhout, Jonas, et al. "Speech intelligibility predicted from neural entrainment of the speech envelope." Journal of the Association for Research in Otolaryngology 19.2 (2018): 181-191.
European Search Report dated May 14, 2020 for EP Appln. No. 19215898.8.
(Continued)

*Primary Examiner* — Yosef K Laekemariam
(74) *Attorney, Agent, or Firm* — Vista IP Law Group, LLP

(57) ABSTRACT

A hearing aid includes: a microphone configured to provide a microphone signal that corresponds with an acoustic stimulus naturally received by a user of the hearing aid; a processing unit coupled to the microphone, the processing unit configured to provide a processed signal based at least on the microphone signal; a speaker coupled to the processing unit, the speaker configured to provide an acoustic signal based on the processed signal; and a sensor configured to measure a neural response of the user to the acoustic stimulus, and to provide a sensor output; wherein the processing unit is configured to detect presence of speech based on the microphone signal, and to process the sensor output and the microphone signal to estimate speech intelligibility; and wherein the processing unit is also configured to adjust a sound processing parameter for the hearing aid based at least on the estimated speech intelligibility.

23 Claims, 6 Drawing Sheets

(58) Field of Classification Search
CPC ..... H04R 2225/43; H04R 2225/53; H04R 2225/55; G10L 21/0208; G10L 21/0332; G10L 21/034; A61B 5/04008; A61B 5/04012; A61B 5/04017; A61B 5/0476; A61B 5/04845
USPC ..... 381/23.1, 312, 324
See application file for complete search history.

(56) References Cited

U.S. PATENT DOCUMENTS

| | | | | |
|---|---|---|---|---|
| 2011/0188664 | A1 | 8/2011 | Morikawa et al. | |
| 2012/0177233 | A1* | 7/2012 | Kidmose ..... | A61B 5/121 381/314 |
| 2014/0098981 | A1* | 4/2014 | Lunner ..... | H04R 25/50 381/320 |
| 2014/0148724 | A1 | 5/2014 | Ungstrup et al. | |
| 2014/0153729 | A1* | 6/2014 | Adachi ..... | H04R 25/70 381/60 |
| 2018/0007477 | A1* | 1/2018 | Devries ..... | H04R 25/552 |
| 2019/0182606 | A1* | 6/2019 | Petersen ..... | H04R 25/505 |

FOREIGN PATENT DOCUMENTS

| | | | |
|---|---|---|---|
| EP | 3214620 | A1 | 9/2017 |
| WO | 2011006681 | A1 | 1/2011 |

OTHER PUBLICATIONS

Dmochowski, J., et al., "Multidimensional stimulus-response correlation reveals supramodal neural responses to naturalistic stimuli", bioRxiv preprint first posted online Sep. 25, 2016.
Looney, D., et al., "Wearable In-Ear Encephalography Sensor for Monitoring Sleep", Ann Am Thorac Soc vol. 13, No. 12, pp. 2229-2233, Dec. 2016.

* cited by examiner

HEARING AIDS WITH SELF-ADJUSTMENT CAPABILITY BASED ON ELECTRO-ENCEPHALOGRAM (EEG) SIGNALS

FIELD

This application relates generally to hearing aids.

BACKGROUND

Fitting hearing aids is a challenge. A number of free parameters of the sound amplification have to be selected based on an individual's need but the best criteria to do so are not well established. Audiograms are readily obtained and provide an objective criterion for gain at different frequency bands, but other parameters such as compression are left without an objective criterion for their selection. The resulting amplification based on audiogram alone does often not translate into good intelligibility of speech and may at times generate uncomfortable amplification of background noise. To address these issues audiologists solicit subjective user feedback and make choices based on their personal experience. However, time with the audiologist is limited to short fitting sessions, behavioral feedback can be unreliable, and the clinical setting is often a poor predictor for everyday experience. This can result in poorly adjusted hearing aids, which lead to poor user satisfaction, including devices that are left unused despite high purchasing cost to the consumer. In short, the fitting process is error prone, out of the control of the manufacturer, and caries a substantial risk to the brand. Soliciting more frequent or ongoing user feedback after dispensing the device maybe cumbersome and may be of limited value for a typically older population.

Therefore, there is an urgent need to adapt hearing aid parameters based on objective criteria, based on day-to-day experience of the user, and requiring minimal or no user feedback.

SUMMARY

Embodiments described herein relate to a hearing aid which can tune itself to improved speech intelligibility. In one implementation, the hearing aid records the sound (acoustic stimulus) naturally received by the user along with the neural responses of the user measured concurrently with the sound. When speech is detected, the sound is correlated with the neural responses and the strength of this correlation is taken as an estimate of speech intelligibility. The parameters of the sound processing in the hearing aid are tuned progressively to improve intelligibility based on this estimate.

A hearing aid includes: a microphone configured to provide a microphone signal that corresponds with an acoustic stimulus naturally received by a user of the hearing aid; a processing unit coupled to the microphone, the processing unit configured to provide a processed signal based at least on the microphone signal; a speaker coupled to the processing unit, the speaker configured to provide an acoustic signal based on the processed signal; and a sensor configured to measure a neural response of the user to the acoustic stimulus, and to provide a sensor output; wherein the processing unit is configured to detect presence of speech based on the microphone signal, and to process the sensor output and the microphone signal to estimate speech intelligibility; and wherein the processing unit is also configured to adjust a sound processing parameter for the hearing aid based at least on the estimated speech intelligibility.

Optionally, the neural response comprises an encephalographic activity.

Optionally, the sensor is configured for placement in an ear canal or outside an ear of the user of the hearing aid.

Optionally, the hearing aid further includes an additional sensor configured for placement in another ear canal or outside another ear of the user of the hearing aid.

Optionally, the processing unit is configured to estimate the speech intelligibility based on a strength of a stimulus-response correlation between the acoustic stimulus containing speech and the neural response.

Optionally, the stimulus-response correlation comprises a temporal correlation of a feature of the acoustic stimulus with a feature of the neural response.

Optionally, the feature of the acoustic stimulus comprises an amplitude envelope of a sound recorded in the hearing aid based on output from the microphone.

Optionally, the feature of the neural response comprises an electroencephalographic evoked response.

Optionally, processing unit is configured to determine the stimulus-response correlation using a multivariate regression technique.

Optionally, the sound processing parameter comprises a long-term processing parameter for the hearing aid.

Optionally, the long-term processing parameter of the hearing aid comprises an amplification gain, a compression factor, a time constant for power estimation, or an amplification knee-point, or any other parameter of a sound enhancement module.

Optionally, the long-term processing parameter is for repeated use to process multiple future signals.

Optionally, the processing unit is configured to use an adaptive algorithm to improve the estimated speech intelligibility.

Optionally, the processing unit is configured to perform reinforcement learning to improve the estimated speech intelligibility.

Optionally, the processing unit is configured to perform a canonical correlation analysis to correlate the neural response with the acoustic stimulus.

Optionally, the processing unit is configured to perform a canonical correlation analysis to build a model that maximizes a correlation between the neural response and the acoustic stimulus.

Optionally, the hearing aid further includes a memory for storing the sensor output.

Optionally, the sensor output comprises at least 30 seconds of data.

Optionally, the processing unit further comprises a sound enhancement module configured to provide better hearing.

Optionally, the hearing aid further includes a memory, wherein the sensor output and the microphone signal are concurrently recorded in the memory of the hearing aid.

Optionally, the hearing aid further includes a memory, wherein the sensor output and the microphone signal are stored in the memory based on a data structure that temporally associate the sensor output with the microphone signal.

A method is performed by a hearing aid having a microphone configured to provide a microphone signal that corresponds with an acoustic stimulus naturally received by a user of the hearing aid, a processing unit configured to provide a processed signal based at least on the microphone signal, a speaker configured to provide an acoustic signal based on the processed signal, and a sensor, the method comprising: obtaining a neural response to the acoustic stimulus by the sensor; providing a sensor output based on the neural response; processing the sensor output and the microphone signal by the processing unit to estimate speech intelligibility; and adjusting a sound processing parameter for the hearing aid based at least on the estimated speech intelligibility.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope.

DESCRIPTION OF THE EMBODIMENTS

Figure 1A:
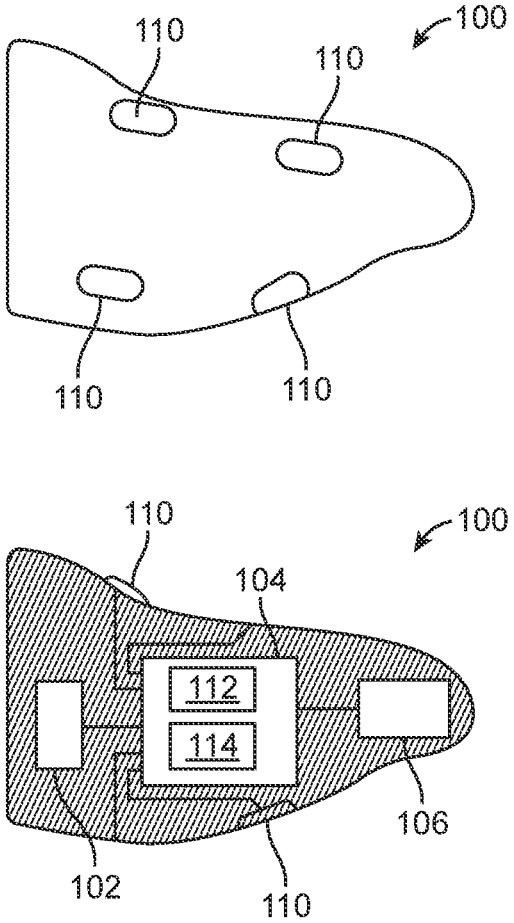
FIGS. 1A-1F illustrate hearing aids having a speech intelligibility estimator according to different embodiments.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

FIG. 1A illustrates a hearing aid 100. The hearing aid 100 includes a microphone 102, a processing unit 104 coupled to the microphone 102, and a speaker 106 coupled to the processing unit 104. The microphone 102 is configured to receive sound and provide a microphone signal based on the acoustic stimulus naturally received by the user. Thus, the microphone signal corresponds with the acoustic stimulus. The processing unit 104 is configured to provide a processed signal based at least on the microphone signal. The speaker 106 is configured to provide an acoustic signal based on the processed signal. Although only one microphone 102 is shown, in some embodiments, the hearing aid 100 may include multiple microphones 102 (e.g., two microphones). The hearing aid 100 also includes sensor(s) 110 configured to measure a neural activity in response to the acoustic signal head by the user. This neural response corresponds to the sensor output. The processing unit 104 is configured to process the sensor output and the microphone signal to estimate speech intelligibility, and adjust sound processing parameter(s) for the hearing aid 100 based at least on the estimated speech intelligibility. In particular, as shown in the figure, the processing unit 104 includes a speech intelligibility estimator 112 configured to process the sensor output and microphone signal to estimate the speech intelligibility, and an adjuster 114 configured to adjust sound processing parameter(s) for the hearing aid 100 based at least on the estimated speech intelligibility.

The processing unit 104 also includes a sound enhancement module (not shown), such as a hearing loss processing module, configured to provide better hearing (e.g., provide hearing loss compensation). The sound enhancement module is configured to generate an enhanced sound signal (e.g., hearing loss compensated signal) based on the microphone signal provided by the microphone 102. The speaker 106 then provides an acoustic signal based on the enhanced sound signal.

In the illustrated embodiments, the sensor output may comprise 30 seconds of data or more (such as, at least 1 minute of data, at least 2 minutes of data, at least 3 minutes of data, at least 5 minutes of data, at least 60 minutes of data, at least 20 minutes of data, at least 30 minutes of data, etc.) for processing by the processing unit 104 to estimate the speech intelligibility. In other embodiments, the sensor output may comprises less than 30 seconds of data. Also, in some embodiments, the amount of data utilized by the processing unit 104 may be for a period it takes to average sensor responses to reduce or eliminate noise.

In some embodiments, the sound processing parameter(s) adjusted by the processing unit 104 may comprise short-term processing parameter(s) and/or long-term processing parameter(s) for the hearing aid. Short-term processing parameter refers to a parameter that changes on a time scale of seconds or less, and long-term processing parameter refers to a parameter that changes on a time scale of a minute or more. For example, a sound amplification gain parameter may be a long-term processing parameter. A short-term parameters may a preferred direction of a bean former, which might need to change from one second to the next.

Figure 1B:
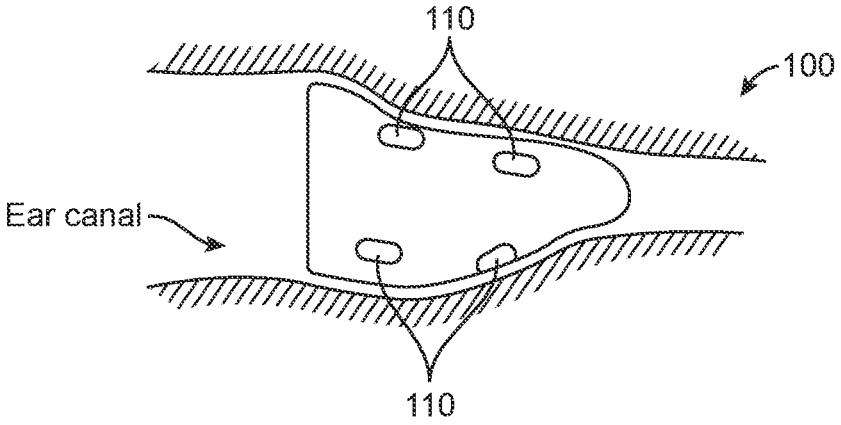
Figure 1C:
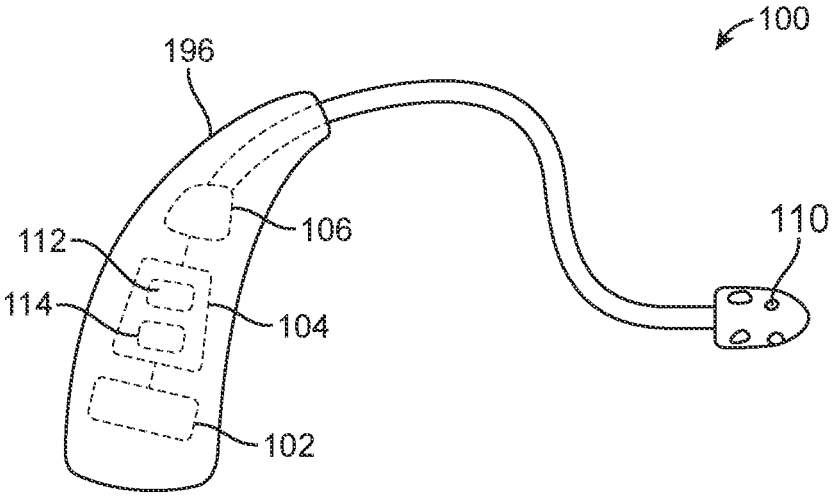
Figure 1D:
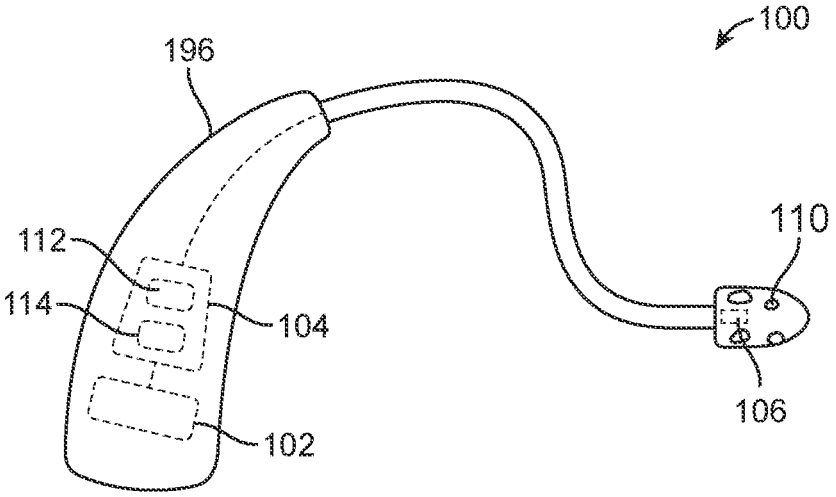

In the illustrated embodiments, the hearing aid 100 is an in-the-ear (ITE) hearing aid. However, in other embodiments, the hearing aid 100 may be other types of hearing aid. By means of non-limiting examples, the hearing aid 100 may be an in-the-canal (ITC) hearing aid (FIG. 1B), a behind-the-ear (BTE) hearing aid (FIG. 1C) with a BTE unit 196, or a receiver-in-the-ear (RITE) (also sometimes called a receiver-in-canal (RIC)) hearing aid (FIG. 1D). In some embodiments the hearing aid 100 may be bilaterally fit (one hearing aid in each ear of the user). In such cases, the hearing aid 100 may be a binaural hearing aid. Also, in some embodiments, the hearing aid 100 may be an Over-The-Counter (OTC) hearing aid that may be obtained without a prescription. The OTC hearing aid may be an ITE hearing aid, an ITC hearing aid, a BTE hearing aid, a RIC hearing aid, or a binaural hearing aid.

The sensor 110 may be configured for placement in an ear canal of the user of the hearing aid 100. In some embodiments, the sensor 110 is configured to sense encephalographic activity of a user of the hearing aid 100. In such cases, the neural response comprises an encephalographic activity (e.g., an electroencephalographic evoked response).

Figure 1E:
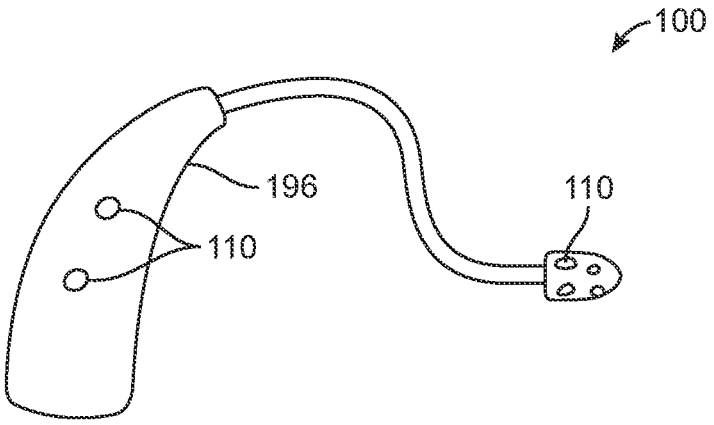
Figure 1F:
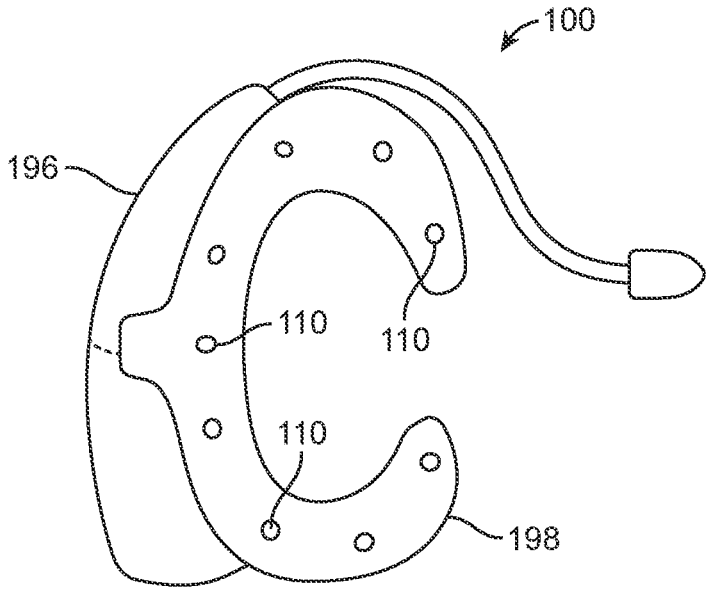

In some embodiments, the sensor 110 may be configured for placement outside an ear of the user of the hearing aid 100. For example, as shown in FIG. 1E, in some embodiments, the hearing aid 100 may include additional sensor(s) 110 at the BTE unit 196 for measuring neural activity. The sensor(s) 110 is on a side of the BTE unit 196 that is configured for placement against a skin of the user of the hearing aid 100. In further embodiments, instead of or in addition to having sensors at the earpiece, the hearing aid 100 may include a substrate 198 carrying sensor(s) 110 for placement around an ear of the user of the hearing aid (FIG. 1F). The substrate 198 may be fixedly attached to the BTE unit 196, or alternatively, detachably coupled to the BTE unit 196 via a connector. Alternatively, the substrate 198 may be separate from the hearing aid 100. In such cases, the substrate 198 may include a transmitter configured to transmit signals from sensors 110 to the hearing aid 100. In other embodiments, the hearing aid 100 may include sensors for placement in both ear canals of the user, around both ears of the user, or in the ear canals and around the ears of the user.

In some embodiments, the processing unit 104 is configured to estimate the speech intelligibility based on a strength of a stimulus-response correlation (SRC) between an acoustic stimulus (represented by the microphone signal) containing speech and the neural response (represented by the sensor output), wherein the sensor output and the microphone signal are concurrently recorded in a memory of the hearing aid 100. In one implementation, the stimulus-response correlation comprises a temporal correlation of a feature of the microphone signal with a feature of the sensor output. For example, the feature of the microphone signal may comprise an amplitude envelope of a sound received by the microphone. Also, in some embodiments, the processing unit 104 may be configured to determine the stimulus-response correlation using a multivariate regression technique.

In some embodiments, in order to use stimulus-response correlation to adjust the hearing aid 100 for improved intelligibility, the processing unit 104 may be configured to detect changes of SRC for the user after recording a limited amount of data (both the microphone signal and the sensor output). In some embodiments, the processing unit 104 is configured to use at least 30 seconds of data (sensor output and microphone signal), such as, at least 1 minute of data, at least 2 minutes of data, at least 3 minutes of data, at least 5 minutes of data, at least 60 minutes of data, at least 20 minutes of data, at least 30 minutes of data, etc.

Accordingly, in some embodiments, the hearing aid 100 further includes a memory for storing the sensor output (representing neural response) and the microphone signal (representing the stimulus that evokes the neural response) associated with the neural response. The memory of the hearing aid 100 may store the sensor output and the microphone signal using a data structure that captures the temporal relationship between the sensor output and the microphone signal. For example, the data structure may comprise a time stamp that ties the sensor output and the microphone signal. This allows the processing unit 104 to know which sensor output corresponds to which microphone signal for which the user produced the neural response. In some embodiments, the memory may store at least 30 seconds of data, such as, at least 1 minute of data, at least 2 minutes of data, at least 3 minutes of data, at least 5 minutes of data, at least 60 minutes of data, at least 20 minutes of data, at least 30 minutes of data, etc. This allows the processing unit 104 of the hearing aid 100 to utilize sufficient amount of the sensor output and corresponding microphone signal to estimate speech intelligibility.

In some embodiments, the processing unit 104 is configured to use an adaptive algorithm to improve speech intelligibility estimation. For example in some embodiments, the processing unit 104 is configured to perform reinforcement learning to improve speech intelligibility estimation.

In some embodiments, the processing unit 104 of the hearing aid 100 is configured to perform a canonical correlation analysis to correlate the sensor output with microphone signal. In one implementation, to compute stimulus-response correlation between the sound envelope and the EEG evoked response, the processing unit 104 (e.g., the speech intelligibility estimator) is configured to perform canonical correlation analysis which extracts several components that correlate between the stimulus with the response. Also, in some embodiments, the processing unit 104 of the hearing aid 100 is configured to perform a canonical correlation analysis to build a model that maximizes a correlation between the neural response and stimulus.

In some embodiments, the long-term processing parameter of the hearing aid may be one or more parameter(s) for use by the processing unit 104 to process sound signals. By means of non-limiting examples, the long-term processing parameter may comprise an amplification gain, a compression factor, a time constant of the power estimation, etc. In some cases, the long-term processing parameter may be for repeated use to process multiple future signals, such as volume amplification gains that are applied continuously to compensate for hearing loss.

Figure 2:
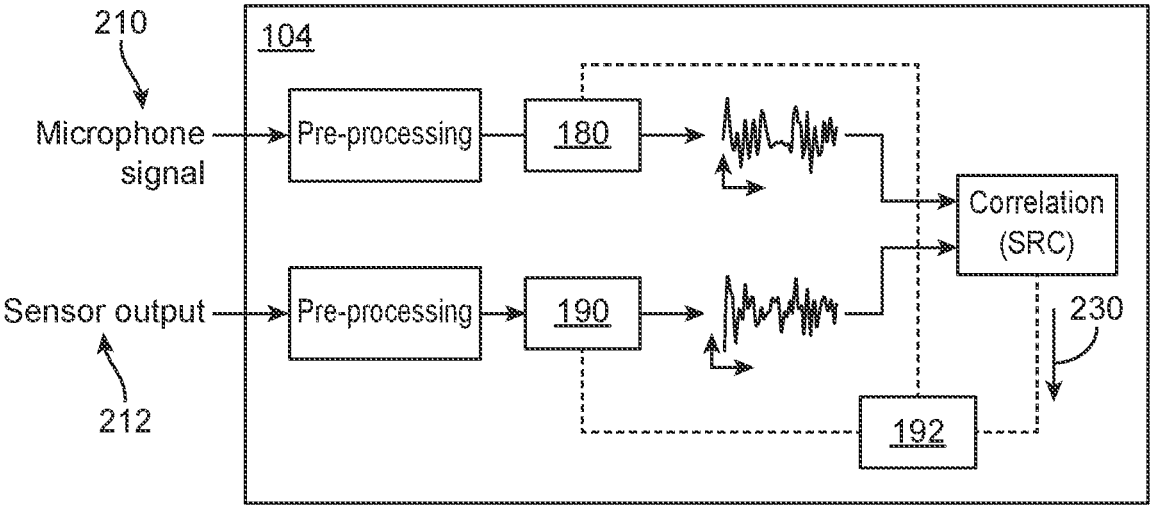
FIG. 2 illustrates signal flow in a hearing aid having a speech intelligibility estimator.

FIG. 2 illustrates a signal flow involved in the hearing aid 100. As shown in the figure, the microphone 102 of the hearing aid 100 receives sound (audio stimulus) from the natural environment of a user of the hearing aid 100, and provides a microphone signal 210 based on the received sound. The microphone signal 210 may then be recorded in the hearing aid 100. The sound may include speech, and so the microphone signal 210 has a speech component. The processing unit 104 of the hearing aid 100 performs pre-processing on the microphone signal 210. In the illustrated embodiments, the pre-processing may include feature detection, such as speech detection. In one implementation, the processing unit 104 may be configured to perform speech detection to detect speech in the microphone signal 210. Also, in some embodiments, the pre-processing may include estimating a sound envelope. The sound envelope can be estimated, for example by band-pass filtering the signal in the frequency band of speech (e.g. 100-400 Hz) and low-pass filtering (e.g. with a low-pass cutoff of 25 Hz) the absolute value of this band-pass filtered sound signal. The processing unit 104 may also perform additional pre-processing to process the recorded microphone signal 210. By means of non-limiting examples, the pre-processing may include filtering, scaling, amplification, averaging, summing, up sampling, down sampling, or any combination of the foregoing.

When the user hears the speech, the user also exhibits a neural response based on the perceived speech. For example, the neural response may comprise an encephalographic activity. The sensor(s) 110 senses the neural response and provides a sensor output 212 (e.g., EEG signal). The processing unit 104 of the hearing aid 100 then pre-processes the sensor output 212 to obtain a processed sensor output 212. For example, the processing unit 104 may have a pre-processing unit configured to perform feature detection, filtering, scaling, amplification, averaging, summing, up sampling, down sampling, or any combination of the foregoing.

In some embodiments, the hearing device 100 may include multiple sensors 110, each of which being configured to provide EEG signal. The processing unit 104 of the hearing aid 100 may examine the EEG data, and may optionally discard data from any channels that are excessively noisy due to electrode or recording quality issues (e.g., by setting them to 0). Additionally, the processing unit 104 may optionally discard any samples that were more than a certain number (e.g., 1, 2, 3, 4) of standard deviations away from the median (in a certain duration of segment), e.g., by setting them to 0.

In some embodiments, the audio signal 210 may be up-sampled or down-sampled. Additionally or alternatively, in some embodiments, the sensor output 212 may be up-sampled or down-sampled.

As shown in FIG. 2, the hearing aid 100 also includes a first signal adjuster 180 for processing the microphone signal 210, and a second signal adjuster 190 for processing the sensor output 212. The first signal adjuster 180 is configured to adjust the microphone signal 210 in a way so that the adjusted microphone signal 210 may be correlated with the sensor output 212 (or an adjusted sensor output 212). Similarly, the second signal adjuster 190 is configured to adjust the sensor output 212 in a way so that it can be correlated with the microphone signal 210 (or the adjusted audio signal 210). In some embodiments, the first signal adjuster 180 may be configured to adjust the microphone signal 210 based on how acoustic signal is represented in brain signal, and so the first signal adjuster 180 may be considered as a form of "encoder". Also, in some embodiments, the second signal adjuster 190 may be configured to adjust the sensor output 212 based on how the sensor output 212 is interpreted, and so the second signal adjuster 182 may be considered as a form of "encoder". Each of the first and second signal adjusters 180, 190 may be configured to remove data (e.g., outliners), combine data, scale data, create data envelope, etc., or any combination of the foregoing. For example, the first signal adjuster 180 may combine the sound envelope estimate in time (e.g., temporally filtering it), and the second signal adjuster 190 may combine multiple neural signals in space (across electrodes), in accordance with equation 1 explained below. Note that the sound envelope is only one of the many features of the speech sound that could be used in this context. Others may include the power envelope at different frequency bands (the spectrogram), or phonetic features of the speech sounds, or any other meaningful features expected to drive neuronal responses. In other embodiments, the hearing aid 100 may not include the first signal adjuster 180 and/or the second signal adjuster 190.

After the microphone signal 210 and the sensor output 212 have been pre-processed, the processing unit 104 then performs correlation based on the obtained processed microphone signal 210 and the processed senor output 212 to obtain a correlation result 230. In some embodiments, the processing unit 104 may be configured to determine (e.g., calculate) a correlation between the processed microphone signal 210 and the processed sensor output 212. If the correlation is high, the speech may be considered intelligible. On the other hand, if the correlation is low, then speech may be considered unintelligible. Thus, the hearing aid 100 described herein is advantageous because it can measure neural activity indicative of speech intelligibility during normal, day-to-day, use of the hearing aid 100 while the user is exposed to sounds in natural environment. This is advantageous because there is no need to generate artificial probing sounds for correlation with EEG signals. Such artificial sounds can be disturbing and distracting to the user. In some embodiments, the sensor 110 senses EEG activity, and provides EEG signal in response to the sensed EEG activity. The EEG signal serves as neural marker for allowing the hearing aid 100 to estimate the user's ability to understand the speech (estimate of speech intelligibility). The EEG signal is obtained passively without requiring the user to actively provide user feedback consciously. Instead, the EEG signal represents cognitive response of the user to speech.

In some embodiments, the processing unit 104 may be configured to determine a correlation between the sensor output 212 and the microphone signal 210 by determining a Pearson correlation value. In some embodiments, if there are multiple sensors 110 for providing multiple sensor output 212, the processing unit 104 may determine multiple correlation values for the respective sensor outputs 212, and may then determine an average of the sum of these sensor outputs 212.

In some embodiments, the processing unit 104 performs correlation based on the obtained processed microphone signal 210 and the processed sensor output 212 to obtain a stimulus-response correlation (SRC) as the correlation result 230. The processing unit 104 may use the SRC to adjust sound processing parameter(s) for the hearing aid 100. In some embodiments, the SRC may be considered as an example of speech intelligibility. In other embodiments, the SRC may be used by the processing unit 104 to determine a speech intelligibility parameter that represents estimated speech intelligibility. In such cases, the processing unit 104 may use the speech intelligibility parameter to adjust sound processing parameter(s) for the hearing aid 100. Furthermore, in some embodiments, the speech intelligibility parameter itself may be considered as an example of speech intelligibility (correlation result 230).

Various techniques may be employed by the processing unit 104 to determine the SRC. In one approach, the processing unit 104 is configured to correlate the amplitude envelope of speech, s(t), with the response in each EEG channel ri(t). This models the brain responses as a linear "encoding" of the speech amplitude. Alternatively, the processing unit 104 may linearly filter the EEG response and combine it across electrodes. This "decoding" model of the stimulus is then correlated to the amplitude envelope of the speech. In both instances, model performance is measured as correlation, either with the stimulus s(t) (decoding) or the response n(t) (encoding). In further embodiments, the processing unit 104 may be configured to use a hybrid encoding and decoding approach, i.e., by building a model that maximizes the correlation between the encoded stimulus $\hat{u}(t)$ (e.g., processed microphone signal 210) and the decoded response $\hat{v}(t)$ (e.g., processed sensor output 212). These two signals may be defined as:

$$\hat{u}(t) = h(t) * s(t) \qquad (1)$$

$$\hat{v}(t) = \sum_i w_i r_i(t)$$

where s(t) represents, in this case, the sound amplitude envelope at time t, h(t) is the encoding filter being applied to the stimulus signal (e.g., microphone signal 210),*represents a convolution, $w_i$ are the weights applied to the neural response (e.g., sensor output 212), and $r_i(t)$ is the neural response at time tin electrode i. In some embodiments, the processing unit 104 is configured to use canonical correlation analysis (CCA) to build a model that maximizes the correlation between the encoded stimulus and decoded response. CCA computes several components (which are linear combinations of multiple signals), each capturing a portion of the correlated signal. For example, in the case of the first signal adjuster 180, a component may capture a combination of time samples of the sound feature (envelope). In the case of the second signal adjuster 190, a component may capture a linear combination of multiple neural sensor signals. The stimulus-response correlation (SRC) may be computed as the sum of the correlation of $\hat{u}(t)$ and $\hat{v}(t)$ for the different components. In one implementation, the processing unit 104 applies CCA to two matrices, one for the stimulus feature (sound amplitude), the other for the brain response (EEG evoked response). The CCA may provide multiple dimensions (components) that are correlated in time between the two data matrices.

It should be noted that the manner in which SRC is determined is not limited to the examples described, and that the processing unit 104 may determine SRC using other techniques. For example, in other embodiments, the processing unit 104 may determine SRC by linearly regressing the neural response with the sound features extracted from the microphone signals, using a least-squares algorithm. Also, SRC should not be limited to the above examples, and in other embodiments, SRC may be any correlation result obtained based on the microphone signal 210 and the sensor output 212. In addition, in some embodiments, the SRC may be considered as an example of speech intelligibility output by the speech intelligibility estimator 112.

Figure 3:
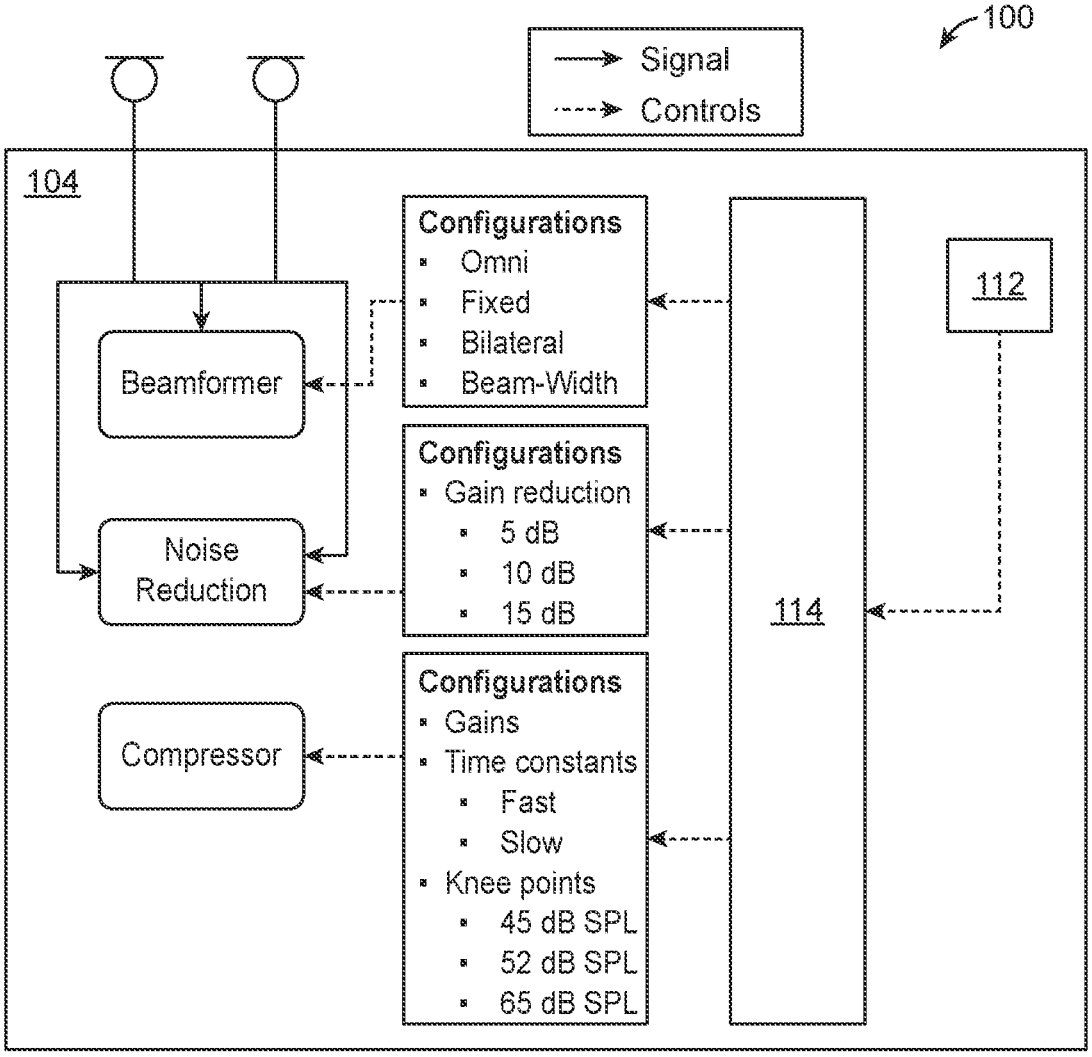
FIG. 3 illustrates an adjuster in a hearing aid adjusting parameters for beamformer, noise reduction module, and compressor of a hearing aid, based on output from a speech intelligibility estimator.

As shown in FIG. 3, in some embodiments, the adjuster 114 of the processing unit 104 may execute a fitting procedure to adjust one or more sound processing parameter(s) for the hearing aid 100 based on an output provided by the speech intelligibility estimator 112. The output by the speech intelligibility estimator 112 may be SRC, a correlation value, a speech intelligibility parameter, or any combination of the foregoing. As shown in the illustrated embodiments, the processing unit 104 may adjust a beam-forming parameter (e.g., by selecting an "omni" setting, a "fixed" setting, a "bilateral" setting, setting a beam-width, etc.) for a beamformer of the hearing aid 100, an amount of gain reduction or increase for a noise reduction module of the hearing aid 100, a gain parameter for the sound enhancement (e.g., hearing loss compensation) of the hearing aid 100, one or more time constants (e.g., setting one or more time constants to fast, slow, or a desired value) for the compressor, setting one or more knee-point(s) for the compressor, or any combination of the foregoing.

In some embodiments, the processing unit 104 may include an evaluator configured to determine whether the SRC is below a certain threshold indicating that the user is losing attention to the speech signal or that the user is intending not to attend to the speech signal. If the SRC is determined to be below the threshold, then the processing unit 104 will adjust one or more sound processing parameter(s) for the compressor, the beamformer, or the noise reduction module of the hearing aid 100.

In some embodiments, the processing unit 104 may adjust multiple sound processing parameters for the respective compressor, beamformer, and the noise reduction module to provide a collective optimized setting for the hearing aid 100. In one implementation, the SRC may be utilized as a cost function, based on which the processing unit 104 performs optimization to determine the sound processing parameter(s) for the compressor, the beamformer, the noise reduction module, or any combination of the foregoing.

Figure 4:
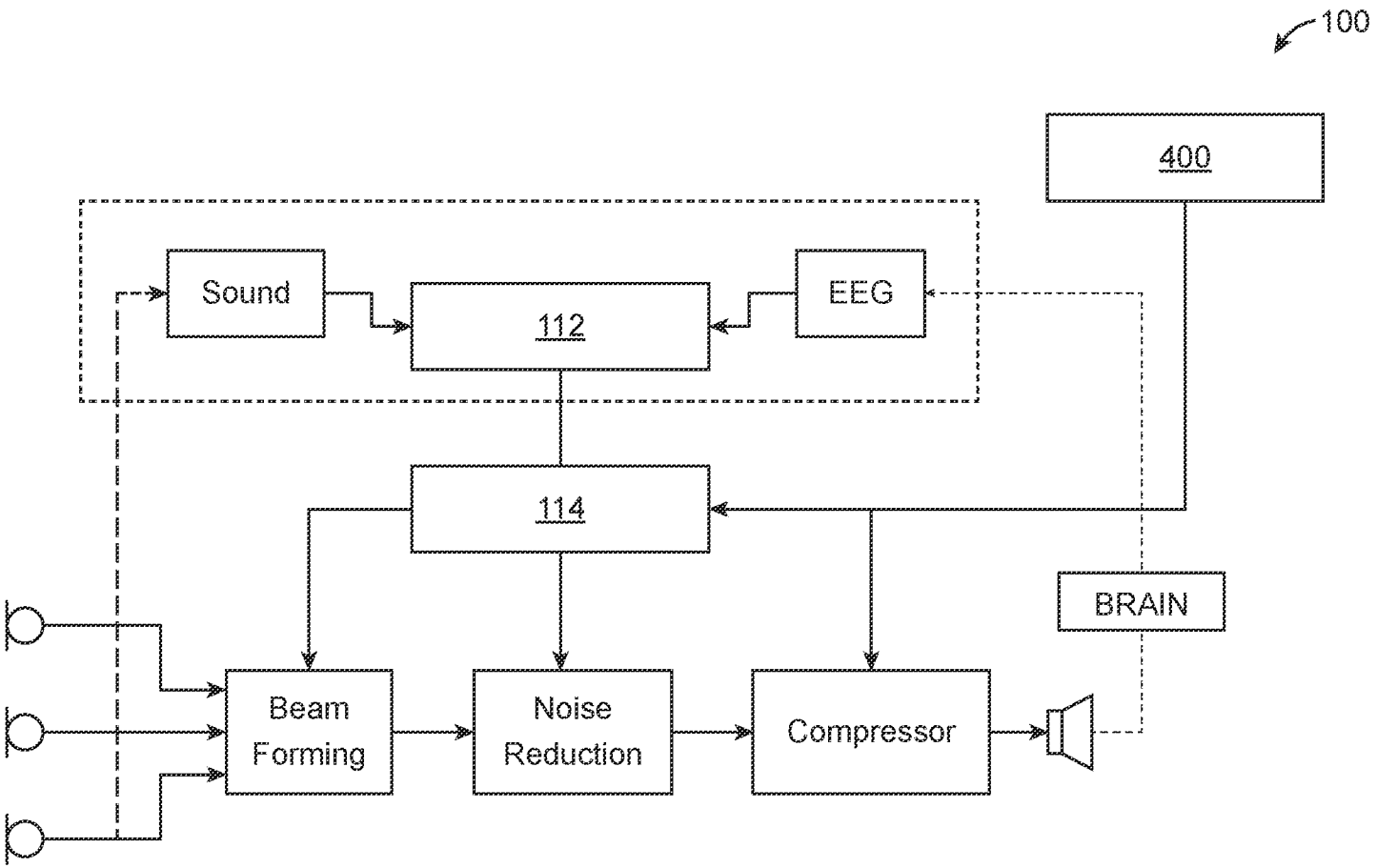
FIG. 4 illustrates a hearing aid having a speech intelligibility estimator and a sound classifier.

In some embodiments, the adjustment of the sound processing parameter(s) may be based on both the estimated speech intelligibility and a sound classification determined by a classifier of the hearing aid 100. In particular, the hearing aid 100 may include a sound classifier 400 (e.g., speech detector or environment classifier) configured to determine a sound classification (e.g., speech detection or environment classification) based on sound received by the microphone 102 and recorded in the hearing aid 100 (FIG. 4). For example, the sound classifier may determine that the user of the hearing aid 100 is in a restaurant, a library, a plane, etc. In such cases, the processing unit 104 may utilize such information to constrain the parameter space for optimization in order to determine a better fit to the settings. For example, when the sound classification indicates that the user of the hearing aid 100 is located in a restaurant, the adjuster 114 of the processing unit 104 may then focus on adjusting the beamforming parameter(s) accordingly. Additionally, in some embodiments, when the speech detector detects speech, the stimulus-response correlation estimate 230 may be limited to times when speech is present in the recorded microphone signal. This information may be used by the processing unit 104 to limit the update of the long-term processing parameters to speech intelligibility estimates obtained only during the presence of speech.

In one or more embodiments described herein, the processing unit 104 may be configured to iteratively estimate speech intelligibility and adjusting sound processing parameter(s) until a desired result is achieved. For example, the desired result may be the SRC reaching a certain prescribed level (e.g., the largest possible level). In such cases, when the processing unit 104 detects that the SRC is below a threshold (indicating low speech intelligibility), the processing unit 104 then adjusts one or more sound processing parameter(s) for the hearing aid 100. The processing unit 104 continues to determine SRC and determine whether the SRC increases back to a desired level. If not, the processing unit 104 then again adjusts one or more sound processing parameter(s) for the hearing aid 100 to attempt to cause the SRC to reach the desired level. The processing unit 104 repeats the above until the SRC reaches the desired level (e.g., the highest possible level). The above technique is advantageous because it does not require a user to confirm whether an adjustment made to one or more sound processing parameter(s) is acceptable or not. Instead, the increase of SRC can be inferred to mean that the adjustment of the sound processing parameter(s) is acceptable to the user.

In other embodiments, the hearing aid 100 may optionally include a user interface (e.g., a button) for allowing a user to confirm whether the adjustment is acceptable or not. For example, whenever the hearing aid 100 automatically makes an adjustment for the sound processing parameter(s), the processing unit 104 may operate the speaker 106 to generate an audio signal informing the user that an adjustment has been made. The user may then have a limited time (e.g., 3 seconds) to press the button to indicate that the adjustment is not acceptable. If the user does not press the button within the time limit, the processing unit 104 may then assume that the adjustment is acceptable. On the other hand, if the user presses the button within the time limit to indicate dissent, then the processing unit 104 may revert back to the previous sound processing parameter(s) for the hearing aid 100.

In some embodiments, the estimated speech intelligibility may be used by the processing unit 104 (e.g., a tuner 192 shown in FIG. 2) to adjust (e.g., tune) the first signal adjuster 180 (encoder) and/or the second signal adjuster 190 (decoder), if the hearing device 100 includes such components. This allows the processing unit 104 to obtain better correlation results. In one technique, the processing unit 104 may be configured to perform a correlated component analysis to perform the tuning.

As illustrated in the above embodiments, the adjustment of the parameters of the hearing aid 100 based on speech intelligibility is advantageous because it is performed automatically and "passively" by the hearing aid 100 without requiring the user of the hearing aid 100 to actively provide user feedback. The hearing aid is essentially fully self-adapting requiring no (or very limited) user or audiologist intervention. This is in contrast to the approach that requires user to actively provide input to indicate levels of speech intelligibility, which is cumbersome and an inconvenience to the user. The approach described herein is also better than the solution that adjusts hearing aid parameters based on audiogram using only threshold sensitivity to pure tones, which may or may not predict speech intelligibility in daily living. Also, the technique described herein does not require presentation of artificial tones or sounds to the user as is typically done to estimate hearing thresholds, including existing solutions that use EEG to detect responses to those synthetic tones. Instead, by correlating neural responses to the naturally perceived sounds, the estimation of how a user's brain responds to sound can be done continuously and unobtrusively during the course of daily living. In addition, because the adjustment of sound processing parameter(s) is based on optimization technique involving long-term hearing experience, it overcomes the limitations of short-term noisy EEG signals. Thus, embodiments described herein will be a significant improvement for current hearing aids, including existing adaptive hearing aids. Embodiments described herein will also be of high value to the Over-The-Counter (OTC) market since it would allow the fitting to be performed without user's active input and with no dispenser or audiologist being present.

Figure 5:
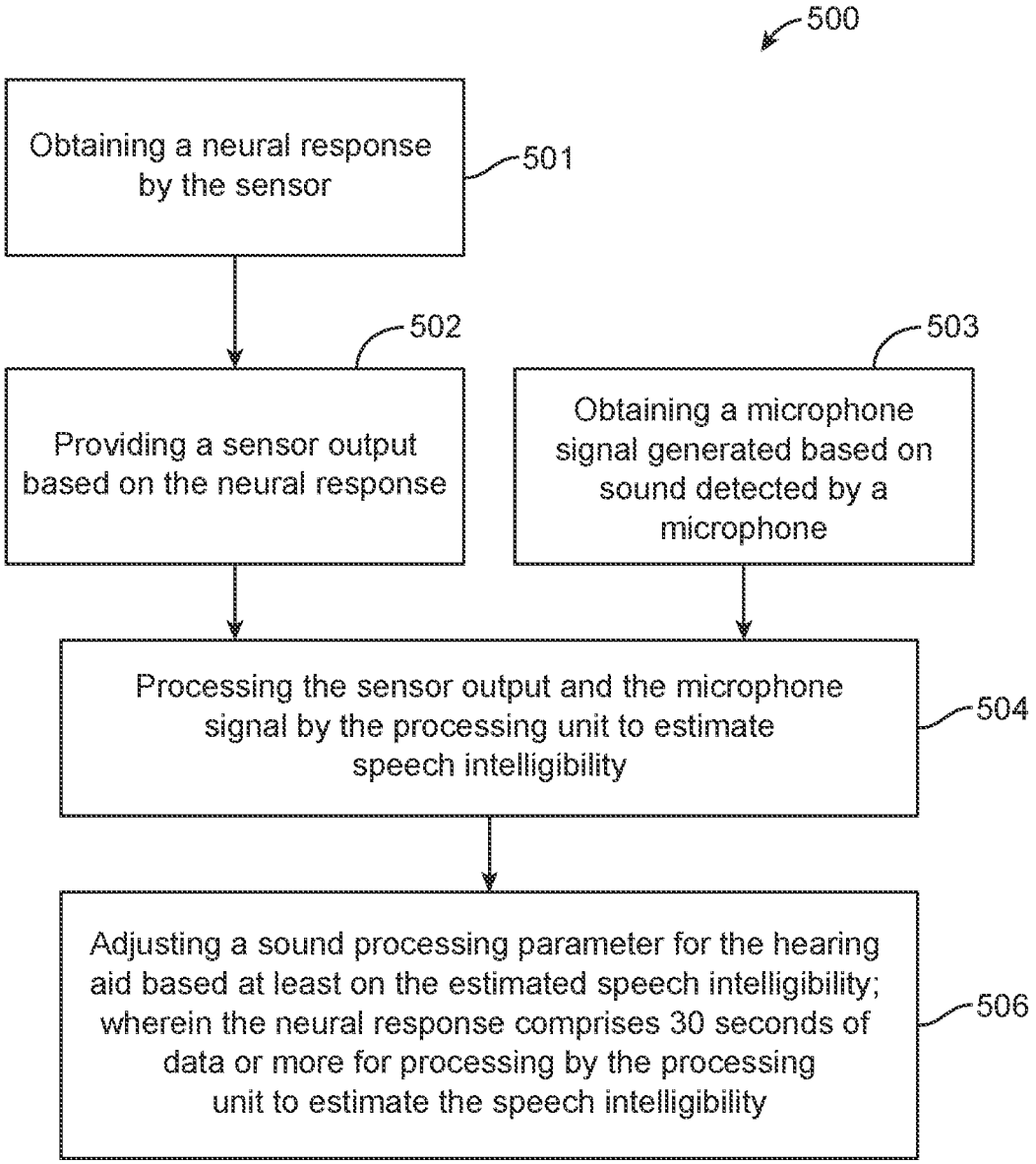
FIG. 5 illustrates a method performed by a hearing aid.

FIG. 5 illustrates a method 500 is performed by a hearing aid. The hearing aid may be the hearing aid of FIG. 1 for example. The hearing aid may have a microphone configured to provide a microphone signal that corresponds with an acoustic stimulus, a processing unit configured to provide a processed signal based at least on the microphone signal, a speaker configured to provide an acoustic signal based on the processed signal, and a sensor. As shown in FIG. 5, the method 500 includes: obtaining a neural response by the sensor (item 501); providing a sensor output by the sensor based on the neural response (item 502); obtaining a microphone signal generated based on sound detected by a microphone (item 503); processing the sensor output and the microphone signal by the processing unit to estimate speech intelligibility (item 504); and adjusting a sound processing parameter for the hearing aid based at least on the estimated speech intelligibility (item 506). The neural response may comprise 30 seconds of data or more for processing by the processing unit to estimate the speech intelligibility. Alternatively, the neural response may comprise less than 30 seconds of data. Also, in some embodiments, the sound processing parameter may comprise a long-term processing parameter for the hearing aid. In some embodiments, item 504 may be performed by the speech intelligibility estimator 112, which provides a correlation result 230 as an example of speech intelligibility.

Although the above embodiments have been described with reference to the hearing aid 100 adjusting itself based on estimated speech intelligibility, in other embodiments, the adjustment of sound processing parameters for a hearing aid based on estimated speech intelligibility may alternatively be performed by a fitting device that is in communication with the hearing aid 100. For example, in one implementation, after the hearing aid 100 is initially set by a fitting device based on an audiogram during a fitting session, a fitter may operate a first loudspeaker to present speech sound for the user of the hearing aid 100, while a second loudspeaker presents noise. The user may then be asked to try to attend to the speech signal while sensors worn by the user measures neural activities. In some cases, the sensor may be EEG sensors. The sensors may be implemented at an earpiece for placement in an ear canal of the user. Alternatively, the sensors may be implemented at a device for worn around the ear of the user and outside the ear canal. In other cases, the sensors may be implemented at a hat or head gear for worn by the user. The processing unit of the fitting device estimates speech intelligibility based on the sensors' output signals in accordance with embodiments of the techniques described herein. Based on the estimated speech intelligibility, the fitting device may then adjust one or more sound processing parameter(s) for the hearing aid 100. For example, the fitting device may adjust one or more parameters of the sound enhancement module, one or more parameters for a beamformer of the hearing aid 100, one or more parameters for a noise reduction module of the hearing aid 100, one or more parameters for a compressor of the hearing aid 100, or any combination of the foregoing, as similarly discussed with reference to the embodiments of FIG. 3.

In further embodiments, one or more features of the processing unit 104 may be implemented on a mobile device, such as a cell phone, an iPad, a tablet, a laptop, etc. For examples, in some embodiments, sensor outputs from the sensor(s) and also microphone signals from the hearing aid 100 may be transmitted to the mobile device, which then estimates speech intelligibility based on the sensor outputs and the microphone signals, as similarly discussed. The mobile device may also be configured to determine one or more adjustments for one or more sound processing parameters for the hearing aid 100. The mobile device may transmit signals to the hearing aid 100 to implement such adjustment(s) at the hearing aid 100.

It should be noted that the term "processing unit" may refer to software, hardware, or a combination of both. In some embodiments, the processing unit 104 may include one or more processor(s), and/or one or more integrated circuits, configured to implement components (e.g., the speech intelligibility estimator 112, the adjuster 114, the sound enhancement module) of the processing unit 104 described herein.

Also, it should be noted that the term "microphone signal", as used in this specification, may refer to the signal directly outputted by a microphone, or it may refer to microphone signal that has been processed by one or more components (e.g., in a hearing aid). Similarly, the term "sensor output", as used in this specification, may refer to signal directly outputted by a sensor, or it may refer to sensor output that has been processed by one or more components (e.g., in a hearing aid).

In addition, the term "microphone signal" may refer to one or more signal(s) output by a microphone, or output by a microphone and processed by component(s). Similarly, the term "sensor output" may refer to one or more signal(s) output by a sensor, or output by a sensor and processed by component(s).

Furthermore, the term "speech intelligibility", as used in this specification, may refer to any data, parameter, and/or function that represents or correlates with speech intelligibility, speech understanding, speech comprehension, word recognition, or word detection of the hearing aid user.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

What is claimed:

1. A hearing aid comprising:

a microphone configured to provide a microphone signal that corresponds with an acoustic stimulus naturally received by a user of the hearing aid;

a processing unit coupled to the microphone, the processing unit configured to provide a processed signal based at least on the microphone signal;

a speaker coupled to the processing unit, the speaker configured to provide an acoustic signal based on the processed signal; and a sensor configured to measure a neural response of the user to the acoustic stimulus, and to provide a sensor output;

wherein the processing unit is configured to detect presence of speech based on the microphone signal, and to process the sensor output and the microphone signal to estimate speech intelligibility;

wherein the processing unit is also configured to adjust a sound processing parameter for the hearing aid based at least on the estimated speech intelligibility; and wherein the estimated speech intelligibility is based on the microphone signal and the sensor output, and wherein the processing unit is configured to use the adjusted sound processing parameter to process future microphone signals.

2. The hearing aid of claim 1, wherein the neural response comprises an encephalographic activity.

3. The hearing aid of claim 1, wherein the sensor is configured for placement in an ear canal or outside an ear of the user of the hearing aid.

4. The hearing aid of claim 3, further comprising an additional sensor configured for placement in another ear canal or outside another ear of the user of the hearing aid.

5. A hearing aid comprising:

a microphone configured to provide a microphone signal that corresponds with an acoustic stimulus naturally received by a user of the hearing aid;

a processing unit coupled to the microphone, the processing unit configured to provide a processed signal based at least on the microphone signal;

a speaker coupled to the processing unit, the speaker configured to provide an acoustic signal based on the processed signal; and a sensor configured to measure a neural response of the user to the acoustic stimulus, and to provide a sensor output;

wherein the processing unit is configured to detect presence of speech based on the microphone signal and the sensor output, and to process the sensor output and the microphone signal to estimate speech intelligibility;

wherein the processing unit is also configured to adjust a sound processing parameter for the hearing aid based at least on the estimated speech intelligibility; and wherein the processing unit is configured to estimate the speech intelligibility based on a strength of a stimulus-response correlation between the acoustic stimulus containing speech and the neural response.

6. The hearing aid of claim 5, wherein the stimulus-response correlation comprises a temporal correlation of a feature of the acoustic stimulus with a feature of the neural response.

7. The hearing aid of claim 6, wherein the feature of the acoustic stimulus comprises an amplitude envelope of a sound recorded in the hearing aid based on output from the microphone.

8. The hearing aid of claim 6, wherein the feature of the neural response comprises an electroencephalographic evoked response.

9. The hearing aid of claim 5, wherein processing unit is configured to determine the stimulus-response correlation using a multivariate regression technique.

10. The hearing aid of claim 1, wherein the sound processing parameter comprises a long-term processing parameter for the hearing aid.

11. The hearing aid of claim 10, wherein the long-term processing parameter of the hearing aid comprises an amplification gain, a compression factor, a time constant for power estimation, or an amplification knee-point, or any other parameter of a sound enhancement module.

12. The hearing aid of claim 10, wherein the long-term processing parameter is for repeated use to process multiple future signals.

13. The hearing aid of claim 1, wherein the processing unit is configured to use an adaptive algorithm to improve the estimated speech intelligibility.

14. The hearing aid of claim 1, wherein the processing unit is configured to perform reinforcement learning to improve the estimated speech intelligibility.

15. The hearing aid of claim 1, wherein the processing unit is configured to perform a canonical correlation analysis to correlate the neural response with the acoustic stimulus.

16. The hearing aid of claim 1, wherein the processing unit is configured to perform a process to increase a correlation between the neural response and the acoustic stimulus.

17. The hearing aid of claim 1, further comprising a memory for storing the sensor output.

18. The hearing aid of claim 1, wherein the sensor output comprises at least 30 seconds of data.

19. The hearing aid of claim 1, wherein the processing unit further comprises a sound enhancement module configured to provide better hearing.

20. The hearing aid of claim 1, further comprising a memory, wherein the sensor output and the microphone signal are concurrently recorded in the memory of the hearing aid.

21. The hearing aid of claim 1, further comprising a memory, wherein the sensor output and the microphone signal are stored in the memory based on a data structure that temporally associate the sensor output with the microphone signal.

22. A method performed by a hearing aid having a microphone configured to provide a microphone signal that corresponds with an acoustic stimulus naturally received by a user of the hearing aid, a processing unit configured to provide a processed signal based at least on the microphone signal, a speaker configured to provide an acoustic signal based on the processed signal, and a sensor, the method comprising:

obtaining a neural response to the acoustic stimulus by the sensor;

providing a sensor output based on the neural response;

processing the sensor output and the microphone signal by the processing unit to estimate speech intelligibility; and adjusting a sound processing parameter for the hearing aid based at least on the estimated speech intelligibility;

wherein the estimated speech intelligibility is based on the microphone signal and the sensor output, and wherein the method further comprises using the adjusted sound processing parameter to process future microphone signals.

23. The hearing aid of claim 1, wherein the sound processing parameter comprises a hearing loss compensation parameter, and wherein the processing unit is configured to adjust the hearing loss compensation parameter based at least on the estimated speech intelligibility.

* * * * *